US010304370B2

(12) United States Patent
Song

(10) Patent No.: US 10,304,370 B2
(45) Date of Patent: May 28, 2019

(54) DRIVING CIRCUIT AND DISPLAY DEVICE

(71) Applicant: Wuhan China Star Optoelectronics Technology Co., Ltd., Wuhan, Hubei (CN)

(72) Inventor: Wenqing Song, Guangdong (CN)

(73) Assignee: Wuhan China Star Optoelectronics Technology Co., Ltd, Wuhan, Hubei (CN)

( * ) Notice: Subject to any disclaimer, the term of this patent is extended or adjusted under 35 U.S.C. 154(b) by 149 days.

(21) Appl. No.: 15/540,977

(22) PCT Filed: May 25, 2017

(86) PCT No.: PCT/CN2017/085873

§ 371 (c)(1),
(2) Date: Jun. 29, 2017

(87) PCT Pub. No.: WO2018/196079

PCT Pub. Date: Nov. 1, 2018

(65) Prior Publication Data

US 2018/0308411 A1 Oct. 25, 2018

(30) Foreign Application Priority Data

Apr. 25, 2017 (CN) ..... 2017 1 0278223

(51) Int. Cl.
*G09G 3/20* (2006.01)

(52) U.S. Cl.
CPC ... *G09G 3/2003* (2013.01); *G09G 2320/0666* (2013.01)

(58) Field of Classification Search
CPC ..... G09G 3/2003; G09G 2320/0666
See application file for complete search history.

(56) References Cited

U.S. PATENT DOCUMENTS

2001/0026250 A1* 10/2001 Inoue ..... G09G 1/28 345/22
2002/0008707 A1* 1/2002 Ido ..... H04N 5/44504 345/589
2002/0024513 A1* 2/2002 Kota ..... G09G 3/3216 345/204

(Continued)

FOREIGN PATENT DOCUMENTS

CN 102063885 A 5/2011
JP 2003084719 A 3/2003

*Primary Examiner* — Kevin M Nguyen
(74) *Attorney, Agent, or Firm* — Andrew C. Cheng

(57) ABSTRACT

A driving circuit and a display device are disclosed. The driving circuit includes a driving chip, a first controllable switch and a resistor. A first lead pin of the driving chip is connected with a second terminal of the first controllable switch, a control terminal of the first controllable switch receives a switching signal, and a first terminal of the first controllable switch is connected with a display region through the resistor. When the driving circuit is under a voltage-dividing operation mode by the resistor, the switching signal is at a low voltage level, the first controllable switch is conductive, and the resistor performs a voltage-dividing, and the display region displays a first type of colors in order to increase the number of the displayed colors so that the delicate degree, aesthetics and layering of a displayed image can be improved.

11 Claims, 4 Drawing Sheets

(56) References Cited

U.S. PATENT DOCUMENTS

| | | | | |
|---|---|---|---|---|
| 2003/0146887 | A1* | 8/2003 | Mametsuka | G09G 3/3291 345/76 |
| 2004/0212632 | A1 | 10/2004 | Inada et al. | |
| 2008/0150874 | A1 | 6/2008 | Kida et al. | |
| 2012/0280959 | A1* | 11/2012 | Shiu | G09G 3/20 345/211 |

* cited by examiner

DRIVING CIRCUIT AND DISPLAY DEVICE

BACKGROUND OF THE INVENTION

1. Field of the Invention

The present invention relates to a display technology field, and more particularly to a driving circuit and a display device.

2. Description of Related Art

Along with the development of the display technology, a display device is widely applied in various fields such as a cell phone, a tablet or an electronic paper and so on. A typical reflective type display device includes a red, a green and blue color filters and a reflective display layer. The reflective display layer is located under the color filters to selectively reflect lights passing through the color filters such that the reflective display device can display an image. The current reflective display device can display 64 colors. Because the number of the displayed color is less, the displayed image is required to be improved in delicate degree, aesthetics and layering.

SUMMARY OF THE INVENTION

The technology problem mainly solved by the present invention is to provide a driving circuit and a display device in order to improve the number of the displayed colors so that the delicate degree, aesthetics and layering of a displayed image can be improved.

In order to solve the above technology problem, a technology solution adopted by the present invention is: a driving circuit, wherein the driving circuit comprises a driving chip, a first controllable switch and a resistor; wherein, a first lead pin of the driving chip is connected with a second terminal of the first controllable switch, a control terminal of the first controllable switch receives a switching signal, and a first terminal of the first controllable switch is connected with a first terminal of the resistor, a second terminal of the resistor is connected with a display region; when the driving circuit is under a voltage-dividing operation mode by the resistor, the switching signal is at a low voltage level, the first controllable switch is conductive, and the resistor performs a voltage-dividing, and the display region displays a first type of colors; a second controllable switch, a first terminal of the second controllable switch is connected with the display region, a control terminal of the second controllable switch receives the switching signal, a second terminal of the second controllable switch is connected with a second lead pin of the driving chip; when the driving circuit is under a normal operation mode, the switching signal is at a high voltage level, and the second controllable switch is conductive such that the display region displays a second type of colors; and a material of the resistor is a semiconductor transparent conductive film made of indium tin oxide, and a resistance of the resistor satisfies a following formula: $R1=\rho*L/S$, wherein, R1 is a resistance of the resistor, $\rho$ is resistivity, L is the length of the resistor, and S is a product of the height and the width of the resistor.

In order to solve the above technology problem, a technology solution adopted by the present invention is: a driving circuit, comprising: a driving chip; a first controllable switch; and a resistor; wherein, a first lead pin of the driving chip is connected with a second terminal of the first controllable switch, a control terminal of the first controllable switch receives a switching signal, and a first terminal of the first controllable switch is connected with a first terminal of the resistor, a second terminal of the resistor is connected with a display region; and when the driving circuit is under a voltage-dividing operation mode by the resistor, the switching signal is at a low voltage level, the first controllable switch is conductive, and the resistor performs a voltage-dividing, and the display region displays a first type of colors.

In order to solve the above technology problem, a technology solution adopted by the present invention is: a display device, the display device includes a driving circuit, and the riving circuit comprises: a driving chip; a first controllable switch; and a resistor; wherein, a first lead pin of the driving chip is connected with a second terminal of the first controllable switch, a control terminal of the first controllable switch receives a switching signal, and a first terminal of the first controllable switch is connected with a first terminal of the resistor, a second terminal of the resistor is connected with a display region; and when the driving circuit is under a voltage-dividing operation mode by the resistor, the switching signal is at a low voltage level, the first controllable switch is conductive, and the resistor performs a voltage-dividing, and the display region displays a first type of colors.

The beneficial effect of the present invention is: comparing with the conventional art, the driving circuit and the display device can make a voltage to be one half of an original voltage through controlling of the first controllable switch and the voltage-dividing by the resistor. Accordingly, the sub-pixel can display a gray color, and the number of the displayed colors is increased so that the delicate degree, aesthetics and layering of a displayed image can be improved.

DETAILED DESCRIPTION OF THE PREFERRED EMBODIMENT

Figure 1:
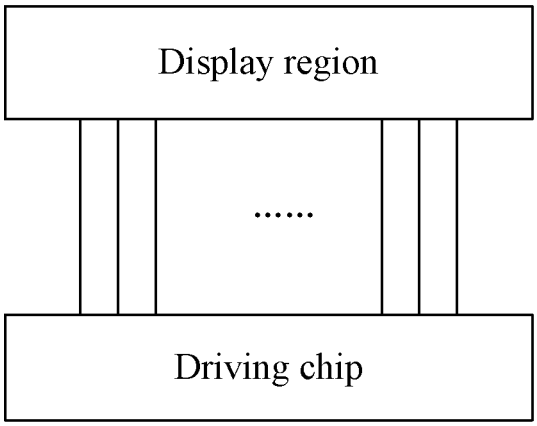
FIG. 1 (Prior Art)
FIG. 1 is a schematic diagram of a driving circuit of the conventional art.
Figure 2:
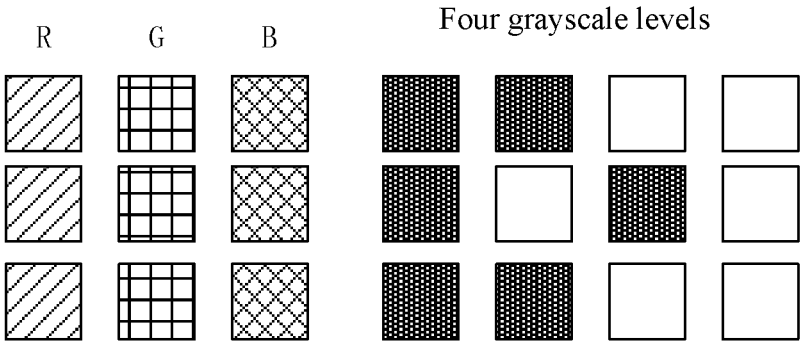
FIG. 2 (Prior Art)
FIG. 2 is a schematic diagram of an area coverage modulation of the conventional art.

With reference to FIG. 1, which is a schematic diagram of a driving circuit of the conventional art. As shown in FIG. 1, a driving chip is connected with a display region for outputting a driving signal to the display region in order to perform an image display. With reference to FIG. 2, which is a schematic diagram of an area coverage modulation of the conventional art. As shown in FIG. 2, each pixel in the display region includes three sub-pixels (that is a red sub-pixel R, a green sub-pixel G and a blue sub-pixel B). Wherein, each sub-pixel is divided into three portions, and each portion only has two states of bright and dark. Accordingly, four grayscale levels are formed so that the three sub-pixels can form one pixel that can display 64 colors. Because the number of the displayed color is limited, the displayed image is required to be improved in delicate degree, aesthetics and layering.

Figure 3:
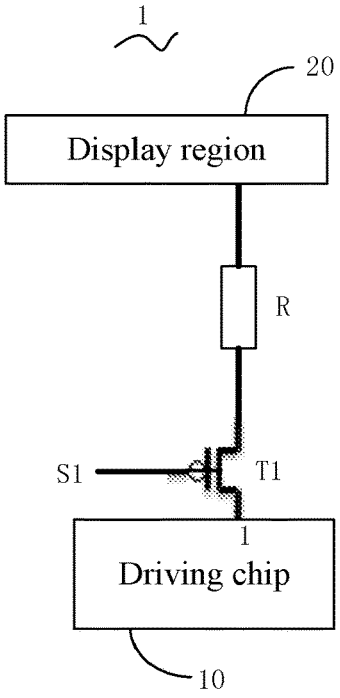
FIG. 3 is a schematic circuit diagram of a driving circuit according to a first embodiment of the present invention.

With reference to FIG. 3, which is a schematic circuit diagram of a driving circuit according to a first embodiment of the present invention. The driving circuit 1 includes a driving chip 10, a first controllable switch T1 and a resistor R. A first lead pin of the driving chip 10 is connected with a second terminal of the first controllable switch T1, a control terminal of the first controllable switch T1 receives a switching signal S1, and a first terminal of the first controllable switch T1 is connected with a first terminal of the resistor R. A second terminal of the resistor R is connected with the display region 20. When the driving circuit 1 is under a voltage-dividing operation mode by the resistor R, the switching signal S1 is at a low voltage level, the first controllable switch T1 is conductive, and the resistor R performs a voltage-dividing. The display region 20 displays a first type of colors.

In the present embodiment, the first type of colors is 729 colors. The first controllable switch T1 is a P-type thin-film transistor. The control terminal, the first terminal and the second terminal of the first controllable switch T1 respectively corresponds to a gate electrode, a drain electrode and a source electrode of the P-type thin-film transistor.

Figure 5:
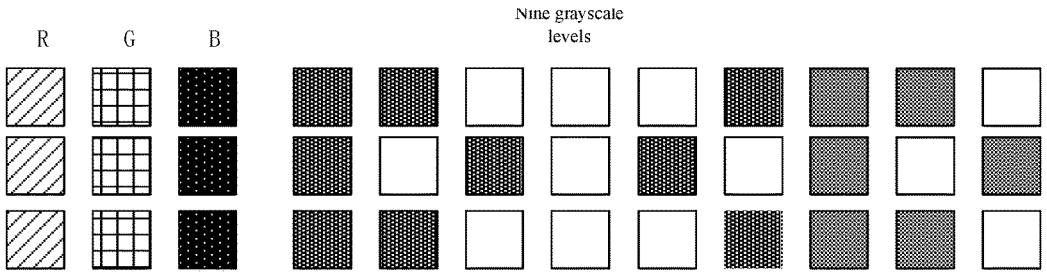
FIG. 5 is a schematic diagram of an operation principle of the driving circuit of the present invention.

With reference to FIG. 3 and FIG. 5, an operation principle of the driving circuit is obtained (using one pixel as an example for illustrating):

When the switching signal is at a low voltage level, the driving circuit is under a voltage-dividing operation mode by a resistor. The first controllable switch T1 is conductive. The first terminal (that is, a drain electrode) of the first controllable switch T1 is connected with a resistor R in series in order to obtain one half of a voltage. By this way, when the sub-pixel is displayed, the sub-pixel will display a color between bright (that is, a white color) and a dark (that is, a dark color), that is a gray color. Each sub-pixel is divided into three portions, but each portion can display three states of black, white and gray. As a result, nine grayscale levels are formed. Accordingly, one pixel that formed by three sub-pixels can display 729 colors. Because the number of the displayed color is increased, the delicate degree, aesthetics and layering of the displayed image is improved. The driving circuit 1 can perform a voltage-dividing through the resistor R having a high resistance such that the voltage is divided into one half of an original voltage. Accordingly, the sub-pixel can display a gray color, and the number of the displayed colors is increased.

Wherein, because the resistor R requires a high resistance, a material of the resistor R can adopts a semiconductor transparent conductive film made of indium tin oxide that has a high resistivity. The other parameters of the resistor R such as height, width and length can select a required value according to an actual requirement. Specifically, the resistance of the resistor R satisfies a following formula: $R1=\rho*L/S$, wherein, R1 is a resistance of the resistor R, $\rho$ is resistivity, L is the length of the resistor R, and S is a product of the height and the width of the resistor R.

Figure 4:
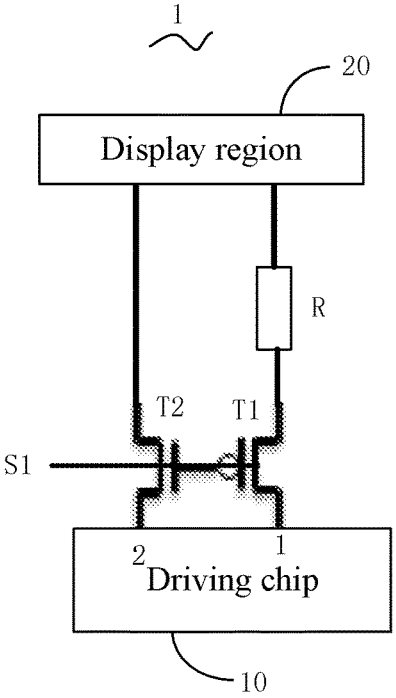
FIG. 4 is a schematic circuit diagram of the driving circuit according to a second embodiment of the present invention.

With reference to FIG. 4, which is a schematic circuit diagram of the driving circuit according to a second embodiment of the present invention. The difference between the second embodiment and the first embodiment of the driving circuit is: the driving circuit 1 further includes a second controllable switch T2. A first terminal of the second controllable switch T2 is connected with the display region 20, a control terminal of the second controllable switch T2 receives the switching signal S1, a second terminal of the second controllable switch T2 is connected with a second lead pin 2 of the driving chip 10. When the driving circuit 1 is under a normal operation mode, the switching signal S1 is at a high voltage level, and the second controllable switch T2 is conductive such that the display region 20 displays a second type of colors.

In the present embodiment, the second type of colors is 64 colors. The second controllable switch T2 is an N-type thin-film transistor. The control terminal, the first terminal and the second terminal of the second controllable switch T2 are respectively correspond to a gate electrode, a source electrode and a drain electrode of the N-type thin-film transistor.

Figure 6:
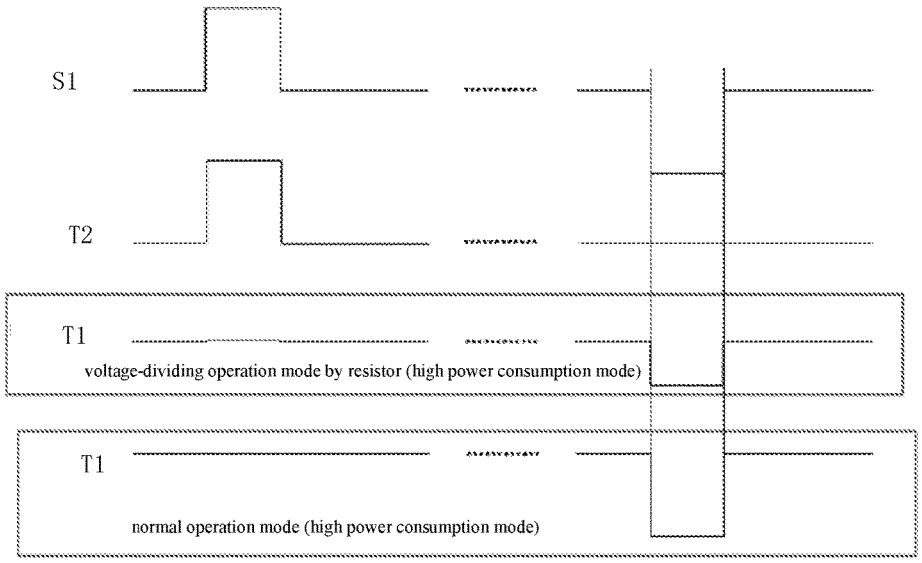
FIG. 6 is a schematic diagram of voltage waveform of FIG. 4.

With reference to FIG. 4 to FIG. 6, an operation principle of the driving circuit is as following (using one pixel for illustrating):

When the switching signal S1 is at a high voltage level, the driving circuit 1 is under a normal operation mode, the second controllable switch T2 is conductive, the display region displays a second type of colors. Wherein, the second type of colors is 64 colors. Wherein, each sub-pixel is divided into three portions, and each portion only has two states of bright and dark. Therefore, 4 grayscale levels are formed such that one pixel that formed by three sub-pixels displays 64 colors.

When the switching signal S1 is at a low voltage level, the driving circuit 1 is under a voltage-dividing operation mode by the resistor R, the first controllable switch T1 is conductive. The first terminal (that is, a drain electrode) of the first controllable switch T1 is connected with the resistor R in series in order to obtain one half of a voltage. By this way, when the sub-pixel is displayed, the sub-pixel will display a color between bright (that is, a white color) and a dark (that is, a dark color), that is a gray color. Each sub-pixel is divided into three portions, but each portion can display three states of black, white and gray. As a result, nine grayscale levels are formed. Accordingly, one pixel that formed by three sub-pixels can display 729 colors. Because the number of the displayed color is increased, the delicate degree, aesthetics and layering of the displayed image is improved.

The driving circuit 1 can display 64 colors through the controlling of the second controllable switch T2 or display 729 colors through the controlling of the first controllable switch T1. Besides, when displaying 729 colors, through the resistor R having a high resistance to perform a voltage-dividing such that the voltage is divided into one half of an original voltage. Accordingly, the sub-pixel can display a gray color, and the number of the displayed colors is increased.

Figure 7:
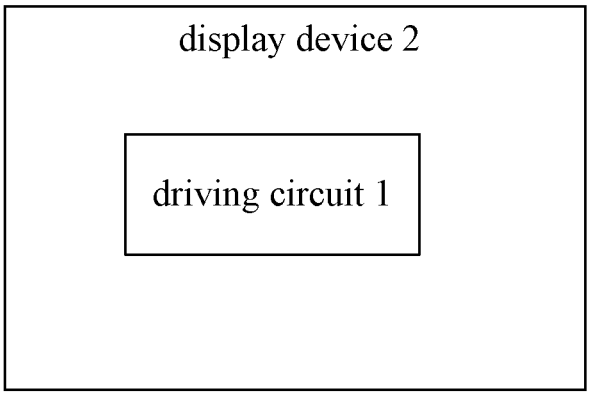
FIG. 7 is a schematic diagram of a display device of the present invention.

With reference to FIG. 7, which is a schematic diagram of a display device of the present invention. The display device 2 includes anyone of the above driving circuit 1. The other devices and functions of the display device are the same as the conventional display device, no more repeating. The display device is a reflective display device.

The driving circuit and the display device can make a voltage to be one half of an original voltage through controlling of the first controllable switch and the voltage-dividing by the resistor. Accordingly, the sub-pixel can display a gray color, and the number of the displayed colors is increased so that the delicate degree, aesthetics and layering of a displayed image can be improved.

The above embodiments of the present invention are not used to limit the claims of this invention. Any use of the content in the specification or in the drawings of the present invention which produces equivalent structures or equivalent processes, or directly or indirectly used in other related technical fields is still covered by the claims in the present invention.

What is claimed is:

1. A driving circuit, wherein the driving circuit comprises a driving chip, a first controllable switch and a resistor; wherein, a first lead pin of the driving chip is connected with a second terminal of the first controllable switch, a control terminal of the first controllable switch receives a switching signal, and a first terminal of the first controllable switch is connected with a first terminal of the resistor, a second terminal of the resistor is connected with a display region; when the driving circuit is under a voltage-dividing operation mode by the resistor, the switching signal is at a low voltage level, the first controllable switch is conductive, and the resistor performs a voltage-dividing, and the display region displays a first type of colors;

a second controllable switch, a first terminal of the second controllable switch is connected with the display region, a control terminal of the second controllable switch receives the switching signal, a second terminal of the second controllable switch is connected with a second lead pin of the driving chip; when the driving circuit is under a normal operation mode, the switching signal is at a high voltage level, and the second controllable switch is conductive such that the display region displays a second type of colors; and a material of the resistor is a semiconductor transparent conductive film made of indium tin oxide, and a resistance of the resistor satisfies a following formula: $R1=\rho*L/S$, wherein, R1 is a resistance of the resistor, ρ is resistivity, L is the length of the resistor, and S is a product of the height and the width of the resistor.

2. A driving circuit, comprising:

a driving chip;

a first controllable switch; and a resistor;

wherein, a first lead pin of the driving chip is connected with a second terminal of the first controllable switch, a control terminal of the first controllable switch receives a switching signal, and a first terminal of the first controllable switch is connected with a first terminal of the resistor, a second terminal of the resistor is connected with a display region; and when the driving circuit is under a voltage-dividing operation mode by the resistor, the switching signal is at a low voltage level, the first controllable switch is conductive, and the resistor performs a voltage-dividing, and the display region displays a first type of colors.

3. The driving circuit according to claim 2, wherein, the driving circuit further includes a second controllable switch, a first terminal of the second controllable switch is connected with the display region, a control terminal of the second controllable switch receives the switching signal, a second terminal of the second controllable switch is connected with a second lead pin of the driving chip; when the driving circuit is under a normal operation mode, the switching signal is at a high voltage level, and the second controllable switch is conductive such that the display region displays a second type of colors.

4. The driving circuit according to claim 3, wherein, the first type of colors is 729 colors, and the second type of colors is 64 colors.

5. The driving circuit according to claim 3, wherein, the first controllable switch is a P-type thin-film transistor; the control terminal, the first terminal and the second terminal of the first controllable switch respectively corresponds to a gate electrode, a drain electrode and a source electrode of the P-type thin-film transistor; the second controllable switch is an N-type thin-film transistor, the control terminal, the first terminal and the second terminal of the second controllable switch are respectively correspond to a gate electrode, a source electrode and a drain electrode of the N-type thin-film transistor.

6. The driving circuit according to claim 2, wherein, a material of the resistor is a semiconductor transparent conductive film made of indium tin oxide, and a resistance of the resistor satisfies a following formula: $R1=\rho*L/S$, wherein, R1 is a resistance of the resistor, ρ is resistivity, L is the length of the resistor, and S is a product of the height and the width of the resistor.

7. A display device, the display device includes a driving circuit, and the riving circuit comprises:

a driving chip;

a first controllable switch; and a resistor;

wherein, a first lead pin of the driving chip is connected with a second terminal of the first controllable switch, a control terminal of the first controllable switch receives a switching signal, and a first terminal of the first controllable switch is connected with a first terminal of the resistor, a second terminal of the resistor is connected with a display region; and when the driving circuit is under a voltage-dividing operation mode by the resistor, the switching signal is at a low voltage level, the first controllable switch is conductive, and the resistor performs a voltage-dividing, and the display region displays a first type of colors.

8. The display device according to claim 7, wherein, the driving circuit further includes a second controllable switch, a first terminal of the second controllable switch is connected with the display region, a control terminal of the second controllable switch receives the switching signal, a second terminal of the second controllable switch is connected with a second lead pin of the driving chip; when the driving circuit is under a normal operation mode, the switching signal is at a high voltage level, and the second controllable switch is conductive such that the display region displays a second type of colors.

9. The display device according to claim 8, wherein, the first type of colors is 729 colors, and the second type of colors is 64 colors; the first controllable switch is a P-type thin-film transistor; the control terminal, the first terminal and the second terminal of the first controllable switch respectively corresponds to a gate electrode, a drain electrode and a source electrode of the P-type thin-film transistor; the second controllable switch is an N-type thin-film transistor, the control terminal, the first terminal and the second terminal of the second controllable switch are respectively correspond to a gate electrode, a source electrode and a drain electrode of the N-type thin-film transistor.

10. The display device according to claim 7, wherein, a material of the resistor is a semiconductor transparent conductive film made of indium tin oxide, and a resistance of the resistor satisfies a following formula: $R1=\rho*L/S$, wherein, R1 is a resistance of the resistor, ρ is resistivity, L is the length of the resistor, and S is a product of the height and the width of the resistor.

11. The display device according to claim 7, wherein, the display device is a reflective display device.

* * * * *